US005996134A

United States Patent [19]

Senninger

[11] Patent Number: 5,996,134

[45] Date of Patent: Dec. 7, 1999

[54] COVER, SPACER AND PLUMBING INSTALLATION ASSEMBLY

[75] Inventor: Ralph B. Senninger, Lexington, Ky.

[73] Assignee: Plastic Productions a LLC, Lexington, Ky.

[21] Appl. No.: 09/018,117

[22] Filed: Feb. 3, 1998

Related U.S. Application Data

[60] Provisional application No. 60/037,838, Feb. 6, 1997.

[51] Int. Cl.[6] ..... E03D 11/16

[52] U.S. Cl. ..... 4/252.4; 4/252.1; 138/96 R

[58] Field of Search ..... 4/252.1, 252.4–252.6; 138/90, 96 R

[56] References Cited

U.S. PATENT DOCUMENTS

| | | | |
|---|---|---|---|
| 595,578 | 12/1897 | Morris . | |
| 629,786 | 8/1899 | Goss . | |
| 658,313 | 9/1900 | Bernardi . | |
| 734,140 | 7/1903 | Schram . | |
| 772,162 | 10/1904 | Luff . | |
| 1,621,647 | 3/1927 | Unke . | |
| 1,642,330 | 9/1927 | Brownstein . | |
| 2,147,263 | 2/1939 | Mills . | |
| 2,202,147 | 5/1940 | Gerriets | 138/96 R |
| 2,454,555 | 11/1948 | Henderson et al. . | |
| 2,601,820 | 7/1952 | Paul et al. . | |
| 2,699,270 | 1/1955 | Nagey et al. . | |
| 2,827,073 | 3/1958 | Owens . | |
| 3,187,777 | 6/1965 | Ashlock . | |
| 3,574,312 | 4/1971 | Miller . | |
| 3,643,267 | 2/1972 | Winter | 4/252.4 |
| 3,800,486 | 4/1974 | Harvey | 138/96 R |
| 3,823,744 | 7/1974 | Logsdon | 138/96 R |
| 3,896,510 | 7/1975 | O'Connell | 4/252.1 |
| 4,052,759 | 10/1977 | Hill | 4/252.4 |
| 4,212,486 | 7/1980 | Logsdon | 4/252.4 |
| 4,233,697 | 11/1980 | Cornwall | 4/252.4 |
| 4,269,232 | 5/1981 | Witschi . | |
| 4,603,443 | 8/1986 | Stewart . | |
| 4,648,139 | 3/1987 | Stokes . | |
| 4,678,097 | 7/1987 | Crute . | |
| 4,827,539 | 5/1989 | Kiziah | 4/252.4 |
| 4,967,422 | 11/1990 | Novak . | |
| 5,115,554 | 5/1992 | Fell, Sr. . | |
| 5,377,361 | 1/1995 | Piskula | 4/252.1 |

*Primary Examiner*—Charles R. Eloshway
*Attorney, Agent, or Firm*—King and Schickli

[57] ABSTRACT

A plumbing installation assembly includes a closet flange and a cooperating spacer and cover. The spacer holds the closet flange above the floor a selected height to allow the pouring of lightweight concrete. The cover fully covers the face and slotted mounting apertures in the closet flange upon which the toilet is mounted.

8 Claims, 3 Drawing Sheets

COVER, SPACER AND PLUMBING INSTALLATION ASSEMBLY

This application claims the benefit of U.S. Provisional Application Ser. No. 60/037,838, filed Feb. 6, 1997 and entitled "Cover, Spacer and Plumbing Installation Assembly".

TECHNICAL FIELD

The present invention relates generally to the plumbing field and, more particularly, to a cover to protect a closet flange from dirt, concrete and other debris during building construction, a spacer for holding a closet flange above a rough-in floor at a desired level for the pouring of concrete and a plumbing installation assembly comprising a closet flange, cover and spacer.

BACKGROUND OF THE INVENTION

The closet flange is well known in the art. The closet flange generally includes a cylindrical pipe portion that extends through an opening in the floor. The closet flange also includes a surrounding base at its inlet end that overlies the floor and is fastened thereto utilizing fasteners of a type well known in the art. When installed, the water closet or toilet is mounted on and bolted to the closet flange. Thus, the closet flange serves as a mounting means for the water closet and also connects the water closet to the plumbing leading to the soil pipe and vent pipe assembly all in a manner well known in the art.

Over time, various closet flange designs have been developed. For example, U.S. Pat. No. 4,648,139 to Stokes discloses a closet flange including a spaced annular head flange and base plate connected together by gussets. Unfortunately, concrete poured on the rough-in floor tends to fill the space between the annular head flange, base plate and gussets so that if it ever becomes necessary to replace the closet flange, it must be broken from the floor.

It should also be appreciated that it is necessary to protect the closet flange from dirt, concrete and other debris during building construction. Otherwise, the closet flange may be damaged. Certainly, at the very least an extensive amount of time may be necessary to clean the flange so that it may provide a good, leak-proof seal with the water closet it is to support. Accordingly, U.S. Pat. No. 4,967,422 to Novak discloses a closet flange protector or cover comprising a substantially cylindrical closed end body. While this cover effectively prevents dirt, concrete and other debris from entering the cylindrical pipe opening or collecting on a plug utilized to seal that opening, it should be appreciated that the cover does not protect the apertures utilized to mount the water closet or toilet in position on the closet flange. Accordingly, those apertures may become filled/plugged with dirt, debris or even hardened concrete which is difficult and time consuming to remove. This significantly increases the expense of the water closet installation In view of the foregoing, it is clear that a need exists for an improved cover and plumbing installation assembly comprising a cover, closet flange and even a spacer to hold the closet flange in proper position above concrete being poured on a rough-in floor.

SUMMARY OF THE INVENTION

Accordingly, it is a primary object of the present invention to provide a cover to protect a closet flange from dirt, concrete and other debris during building construction, a spacer for holding a closet flange above a rough-in floor at a level equal to or above concrete to be poured upon the rough-in floor and a complete plumbing installation assembly comprising a closet flange, spacer and cover overcoming the above described limitations and disadvantages of the prior art.

Yet another object of the present invention is to provide a cover for a closet flange which functions to not only protect the cylindrical pipe opening of the closet flange from entry and build-up of dirt, concrete and other debris but also the apertures in the closet flange utilized to mount the water closet or the toilet to the closet flange during final bathroom fixture installation.

Still another object of the present invention is to provide a spacer for holding a closet flange above a rough-in floor at a level equal to or above concrete to be poured upon the rough-in floor so as to thereby provide a stable support platform for the closet flange.

Yet another object of the present invention is to provide a complete plumbing installation assembly including a closet flange having a base for mounting the closet flange to the floor, a spacer for supporting the closet flange above the floor at a selected height and a cover having a body including a side wall and top wall for fully covering a sealing face of the closet flange.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a cover is provided to protect the closet flange from dirt, concrete and other debris during building construction. As broadly defined, the cover includes a body having a sidewall and top wall for fully covering the face of the closet flange including the apertures provided in the base of the closet flange for receiving fasteners used to secure a water closet or toilet to the closet flange.

More specifically, the cover may be described as including a sidewall having a shoulder and downwardly depending skirt covering an outwardly directed surface or sidewall of the base of the closet flange. Further, the cover preferably includes a frangible portion that may be broken away in order to gain access to the closet flange when building construction is otherwise completed and it is time to mount the water closet or toilet in position.

More specifically, the outer margin of the shoulder preferably includes a breakaway line of frangible material that allows the frangible portion of the body to be selectively removed so as to expose the closet flange and allow completion of the plumbing fixture installation.

In accordance with yet another aspect of the present invention a spacer is provided for holding the closet flange above a rough-in floor at a level equal to or above concrete to be poured upon the rough-in floor. More specifically, the spacer comprises an annular body of diameter greater than or equal to the diameter of the closet flange. Further, the spacer includes at least two arcuate slots for allowing the passage of fasteners from the closet flange through the spacer body into the rough-in floor. Accordingly, the closet flange and spacer may be secured to the floor in the desired position. Further, when concrete is subsequently poured around the closet flange and spacer, the closet flange is held at the desired height above the concrete. Further, concrete is prevented from coming between the closet flange and the rough-in floor since there is no space for its entry. Accordingly, the closet flange is supported on a stable and secure platform defined by the spacer.

In accordance with yet another aspect of the present invention, a complete plumbing installation assembly is provided. The plumbing installation assembly comprises a closet flange including a base for mounting the closet flange to the floor as well as the spacer and cover previously described.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
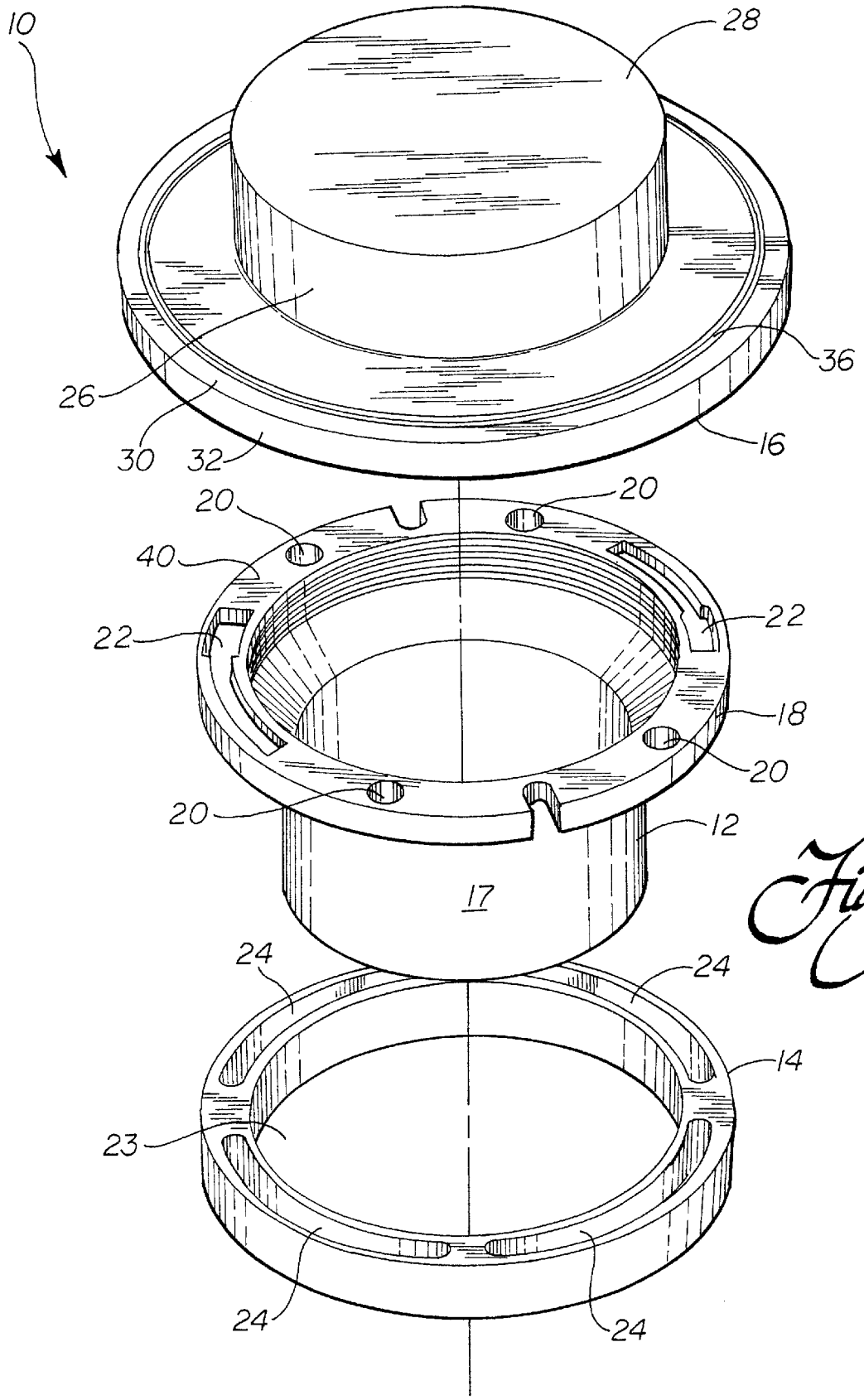
FIG. 1 is an exploded view of the plumbing installation assembly of the present invention including a cover, a closet flange and an associated spacer.

Reference is now made to FIG. 1 generally showing the plumbing installation assembly 10 of the present invention including a closet flange 12, a spacer 14 and a cover 16 that all may be made from polyvinyl chloride or other appropriate material. The closet flange 12 may be of any type generally known in the art including, for example, that shown in U.S. Pat. No. 5,115,554 to Fell, Sr. As is well known, such a closet flange 12, includes a base or floor stratum 18 having a series of apertures 20 for receiving fasteners such as screws (not shown) for mounting the base to the rough-in floor F as described in greater detail below (see also FIG. 2*a*). Further, the base 18 includes a series of slotted apertures 22 for receiving fasteners such as bolts (not shown) by which a water closet, toilet or bathroom fixture may be secured to the closet flange 12.

The spacer 14 is essentially an annular ring including at least two arcuate slots 24. These slots 24 are aligned with the apertures 20 so as to allow the passage of fasteners that extend through the apertures in the closet flange 12 and the slots in the spacer 14 and function to secure the closet flange and spacer to the rough-in floor F.

Figure 3:
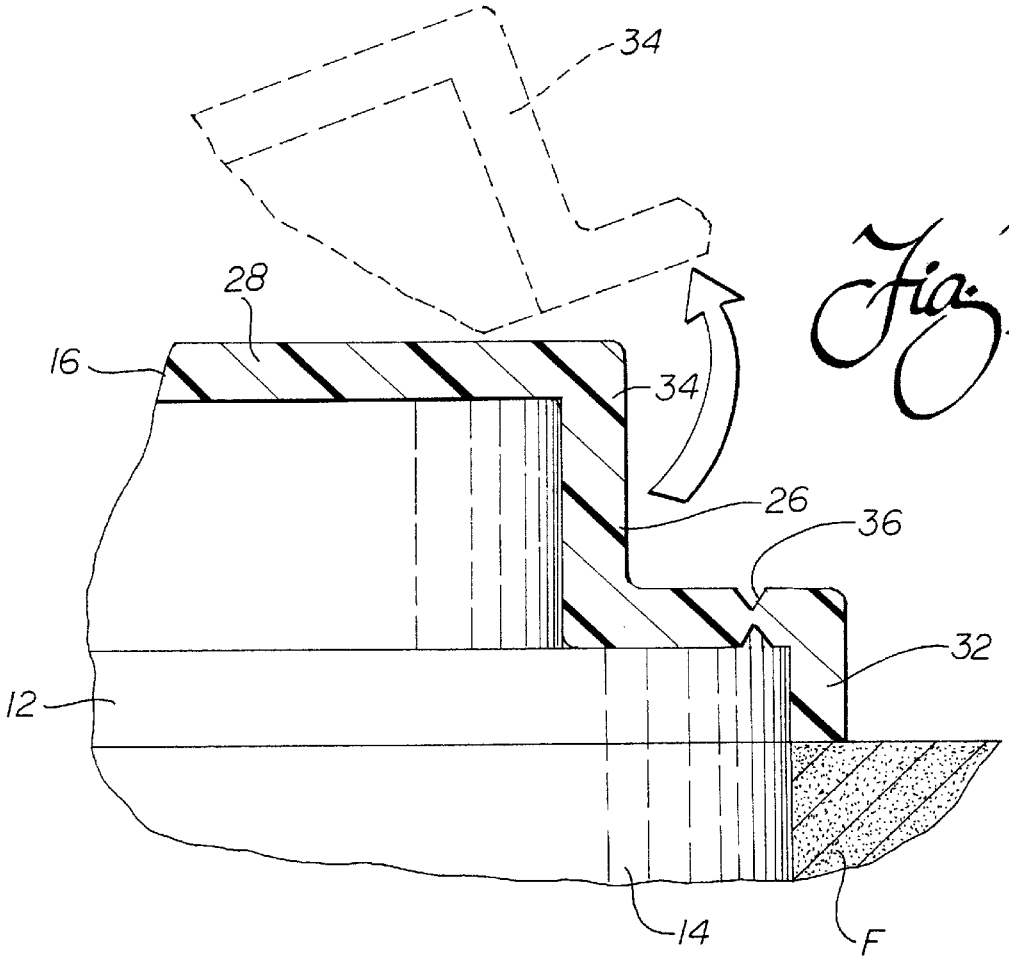
FIG. 3 is a detailed cross-sectional view showing the breakaway or frangible line of the cover adjacent the shoulder sidewall.
Figure 4:
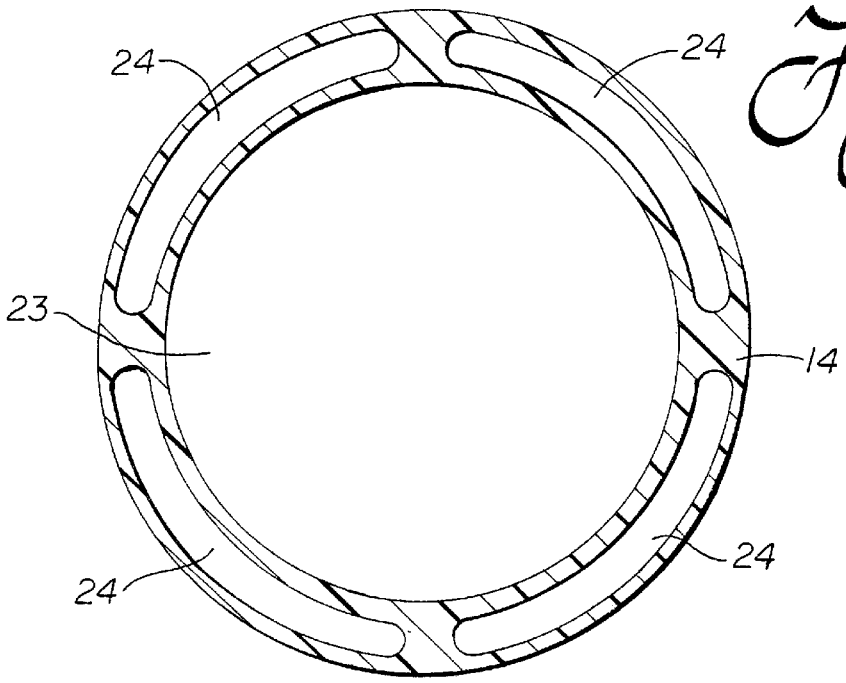
FIG. 4 is a plan view of the spacer.

The cover 16 includes a body having a sidewall 26 and top wall 28. Preferably, the sidewall includes a shoulder 30 and a downwardly depending skirt 32. Additionally, as will be described in greater detail below and best shown in FIG. 3, the cover 16 includes a frangible portion 34 that may be broken away in order to gain access to the closet flange 12 when desired. More specifically, a breakaway line 36 is provided in the upper face of the shoulder 30 adjacent its outer margin. While the entire cover 16 is an integral component at the time of installation, the striking of one or more solid blows to the sidewall 26 with a blunt instrument breaks the frangible portion 34 free at the breakline 36 so that it may be removed as desired.

Figure 2A:
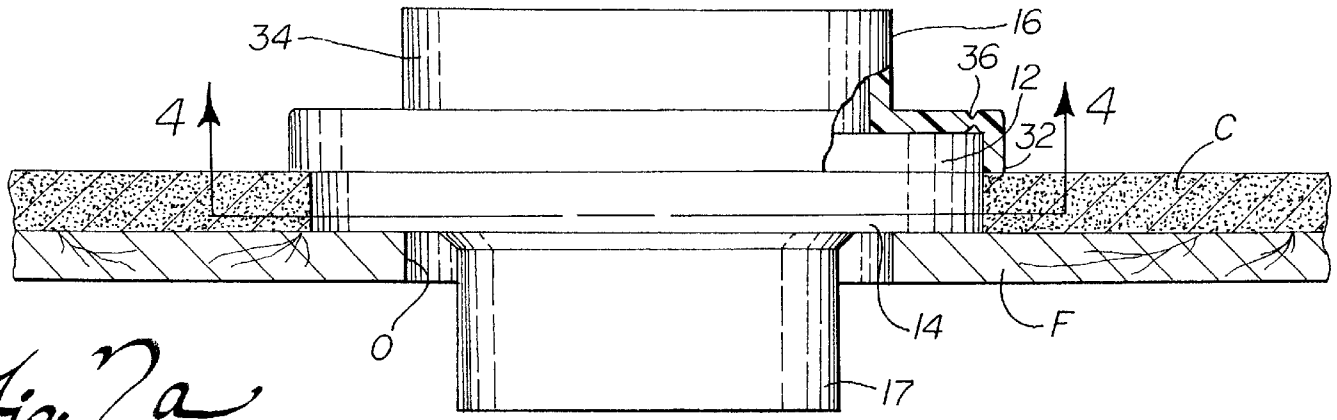
FIG. 2*a* is a partially cross-sectional, side elevational view showing the complete plumbing installation assembly just following pouring of the concrete on the rough-in floor.

Reference is now made to FIG. 2*a* illustrating the use of the plumbing installation assembly 10 of the present invention. During construction, a rough-in floor F of plywood or other material is provided. The desired position of the water closet or toilet is identified and an opening O is cut in the floor F. Next, the closet flange 12 is installed. First, the downwardly depending pipe portion 17 of the closet flange 12 is inserted through the central opening 23 of the spacer 14. Next, the closet flange 12 and spacer 14 are rotated relative to one another until the four mounting apertures 20 in the closet flange align with the slots 24 in the spacer. If desired, adhesive may be used to hold the closet flange 12 and spacer 14 together. The closet flange and spacer subassembly 12, 14 is then installed in the opening O in the floor F. It should be appreciated that the closet flange 12 and spacer 14 are both of a greater diameter than the opening O and fasteners such as wood screws (not shown) may be utilized to secure the closet flange and spacer in position. Specifically, the screws are passed through the apertures 20 in the closet flange 12 and the slots 24 in the spacer 14 and driven into the rough-in floor F so that the heads of the screws positively secure the closet flange and spacer into position over the opening O.

Next, the cover 16 is positioned over the closet flange 12 and spacer 14. More specifically, as best shown in FIG. 2*a*, the downwardly depending skirt 32 of the cover 16 is of sufficient diameter to be fully received over the closet flange 12. Preferably, when the shoulder 30 of the cover 16 engages the base 18 of the closet flange 12, the downwardly depending skirt 32 encircles the sidewall or edge of the closet flange 12. In some applications it may be desired for the skirt 32 to cover part or all of the sidewall or edge of the spacer 14 as well. Further, if desired, the cover 16 may include one or more mounting tabs or lugs (not shown) that project outwardly from the lower edge of the skirt 32 and through which one or more screws or tacks may be driven to secure the cover over the closet flange 12 and spacer 14 against the floor F.

With the cover 16 in position, the lightweight concrete C may now be poured on the rough-in floor F. Specifically, the concrete C is mixed and a thin layer of the concrete is poured and leveled so as to surround the spacer 14. Advantageously, the spacer 14 is of a height slightly greater than or equal to the depth of the concrete and has a diameter equal to or slightly greater than the diameter of the closet flange 12. As a result of this design, there are no gaps and it is not possible for any of the lightweight concrete C to get in between the closet flange 12 and the rough-in floor F. Accordingly, the spacer 14 provides a secure and stable base for the closet flange 12. Further, the spacer 14 may be provided in any thickness necessary in order to match the thickness of the concrete to be poured on the rough-in floor. Of course, the cover 16 also insures that no concrete or any other dirt or debris contacts the uppermost face 40 of the closet flange which provides the seal with the water closet or toilet, the pipe portion 17 or even in the apertures 22 utilized to secure the water closet to the closet flange.

Figure 2B:
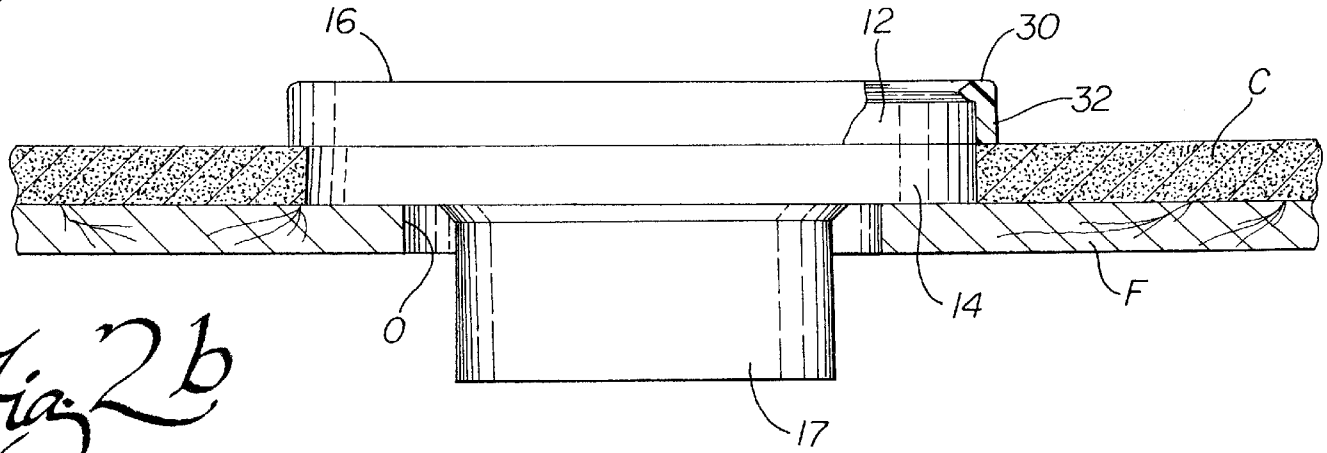
FIG. 2*b* is a view similar of FIG. 2*a* but showing the frangible portion of the cover removed so as to allow access to the closet flange for installation to the bathroom fixture.

After the concrete C dries and construction is otherwise completed, the time is reached to finish the bathroom and install the bathroom fixtures. The installation may be easily completed by striking the sidewall 26 of the cover 16 one or more times with a blunt instrument such as a hammer along the upper margin thereof and in a plane substantially parallel to the top wall 28. This causes the shoulder 30 of the cover 16 to break along the breakaway line 36 thereby allowing the frangible portion 34 to be removed (note particularly, FIGS. 2*b* and 3). This removal serves to expose a plug (not shown) that is provided in the throat of the pipe portion 17 of the closet flange 12. The upper face 40 of the closet flange 12 has been maintained clean by the cover 16 and, therefore, provides a good, clean, smooth surface for sealing against the water closet. Further, the water closet mounting apertures 22 are free and clear of dirt and debris. Accordingly, no cleaning of any surfaces is necessary and water closet installation may be quickly and easily completed in a manner well known in the art.

As a further advantage of the present plumbing installation assembly 10, it should be appreciated that the ring-like portion of the cover 16 not broken away (i.e. shoulder 30 and skirt 32) is maintained as a barrier between the now set lightweight concrete C and the closet flange 12. Accordingly, if it becomes necessary in the future, the closet flange 12 may be removed and replaced without otherwise destroying or damaging the floor.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. A spacer for holding a closet flange including an annular base of diameter D having substantially planar top and bottom faces above a rough-in floor at a level equal to or above concrete to be poured upon the rough-in floor, said spacer comprising;

an annular body having a diameter≧D and substantially planar upper and lower surfaces, said upper surface contacting and supporting a corresponding planar bottom face of the annular base of the closet flange in use such that substantially no gap exists therebetween, said planar upper surface of said body being at least level to or above the concrete when installed;

said substantially planar lower surface of said body resting on and being supported by the rough-in floor when installed;

said body of said spacer including at least two arcuate slots for allowing the passage of fasteners from apertures formed in said annular base of said closet flange through said body into the rough-in floor.

2. A plumbing installation assembly, comprising:

a closet flange including a base having at least one first aperture for receiving a fastener for mounting said closet flange to a floor, said base having a top face and a bottom face;

a spacer having a planar upper surface for mating with said bottom face of said base of said closet flange and supporting said closet flange base above the floor a selected distance, said spacer including at least one second aperture at least partially aligning with said first aperture in said base of said closet flange for allowing the fastener to pass through said spacer and into the floor; and a removable cover having a body including a sidewall and a top wall, said cover overlying and substantially sealing said top face of said closet flange.

3. The assembly of claim 2, wherein said sidewall of said cover includes a shoulder and a downwardly depending skirt for covering an outwardly directed surface of said base of said closet flange.

4. The assembly of claim 3, wherein said shoulder includes a breakaway line allowing a frangible portion of said body to be selectively removed so as to expose said closet flange.

5. The assembly of claim 2, wherein said body includes a frangible portion that may be broken away in order to gain access to said closet flange.

6. The plumbing installation assembly according to claim 2, wherein said at least one second aperture in said spacer is an arcuate slot.

7. A cover to protect a closet flange from dirt, concrete poured on a rough-in floor, or other debris during building construction, said cover comprising:

a body for fully covering and sealing a top face of said closet flange including apertures that receive fasteners used to secure a water closet to said closet flange prior to pouring the concrete;

said body having a downwardly depending skirt for covering at least an outwardly directed surface of a base of said closet flange and a shoulder including a breakaway line allowing a frangible portion of said body to be selectively removed so as to expose said apertures in said base of said closet flange while leaving at least an inwardly directed portion of said shoulder and said downwardly depending skirt intact;

whereby said intact portion of said inwardly directed shoulder and said depending skirt of said cover together provide a barrier between the outwardly directed surface of the base of the closet flange and the floor.

8. The cover according to claim 7, wherein said breakaway line is provided in an upper face of the shoulder adjacent to an outer margin thereof.

* * * * *